US005609056A

United States Patent [19]

Seeber

[11] Patent Number: 5,609,056

[45] Date of Patent: Mar. 11, 1997

[54] SWAGING MACHINE

[75] Inventor: Alfred Seeber, Garsten/Steyr, Austria

[73] Assignee: GFM Gesellschaft für Fertigungstechnik und Maschinenbau Aktiengesellschaft, Steyr, Austria

[21] Appl. No.: 373,638

[22] Filed: Jan. 17, 1995

[30] Foreign Application Priority Data

Jan. 18, 1994 [AT] Austria ..... A 83/94

[51] Int. Cl.[6] ..... B21J 13/00

[52] U.S. Cl. ..... 72/446; 100/257

[58] Field of Search ..... 72/450, 446, 448; 100/257

[56] References Cited

U.S. PATENT DOCUMENTS

| | | | |
|---|---|---|---|
| B 561,166 | 3/1976 | Waller et al. | 100/257 |
| 4,096,728 | 6/1978 | Glecker et al. | 100/257 |
| 4,677,908 | 7/1987 | Imanishi et al. | 100/257 |
| 5,345,861 | 9/1994 | Brewer et al. | 100/257 |
| 5,349,902 | 9/1994 | Daniel et al. | 72/446 |
| 5,445,072 | 8/1995 | Yagi et al. | 72/446 |

FOREIGN PATENT DOCUMENTS

| | | | |
|---|---|---|---|
| 370351 | 3/1983 | Austria . | |
| 0144899 | 6/1988 | Japan | 100/257 |
| 4112000 | 4/1992 | Japan | 100/257 |

*Primary Examiner*—David Jones
*Attorney, Agent, or Firm*—Collard & Roe, P.C.

[57] ABSTRACT

A swaging machine is provided with connecting rod-like swaging hammers, which are driven by eccentrics and radially guided in a machine frame with respect to the axis of the eccentric shaft and for a driving connection are provided at that end which faces the eccentric with a sliding surface in sliding contact with a slide ring that surrounds and is rotatably mounted on the eccentric. A particularly simple design of the machine is achieved in that radially inner end of the hammer and the slide ring are merely non-positively coupled and a compression spring means supported against the machine frame apply pressure to the swaging hammer and urge the sliding surface at the radially inner end of the hammer against the slide ring.

10 Claims, 3 Drawing Sheets

SWAGING MACHINE

BACKGROUND OF THE INVENTION

1. Field of the Invention

This invention relates to a swaging machine comprising connecting rod-like driven hammers, which are longitudinally guided in a machine frame and are preferably driven by eccentrics and radially guided in a machine frame with respect to the axis of the eccentric shaft and for a driving connection are provided at that end which faces the eccentric with a surface in sliding contact with a slide ring, which surrounds and is rotatably mounted on the eccentric.

2. Description of the Prior Art

In the previous practice, the rotation of the eccentric has been converted to the reciprocating motion of each swaging hammer by a positive coupling between the slide ring and the radially inner end of the hammer. To that end the slide ring extends into a transversely extending cam slot in the end of the hammer. In that case the radially inner end of the hammer guides the slide ring along two mutually opposite sliding surfaces and for this purpose the radially inner end of the hammer in most cases surrounds the slide ring and also the eccentric. But it has also already been proposed to provide the slide ring with a guide rail, which faces the radially inner end of the hammer, and to provide the radially inner end of the hammer with a T-shaped guide plate, which extends into said guide rail (Austrian Patent Specification 370,351). But in all eccentric-driven swaging hammers which are similar to connecting rods the positive driving connection involves a large overall space requirement and a high expenditure of material so that particularly machines comprising a plurality of hammers have large dimensions and a heavy weight. Besides, the dead-center positions cannot be adjusted unless special housings comprising the bearings for the eccentric shafts are provided and such an adjusting housing will reduce the stiffness of the machine frame, which must be provided with suitable bearing openings. Moreover, the adjustment will involve a displacement of the center of the eccentric shaft so that that displacement must be taken up by expensive means for driving the eccentric shaft.

SUMMARY OF THE INVENTION

For this reason it is an object of the invention to eliminate said disadvantages and to provide a swaging machine which is of the kind described first hereinbefore and distinguishes by having a particularly simple drive system so that a robust and compact structure may be adopted.

That object is accomplished in accordance with the invention in that the radially inner end of the hammer and the slide ring are merely frictionally coupled and a compression spring means supported against the machine frame apply pressure to the swaging hammer and urge the sliding surface at the radially inner end of the hammer against the slide ring. Owing to that frictional driving connection it is sufficient for the slide ring to impart to the hammer the outwardly directed working stroke whereas the return stroke is imparted to the swaging hammer by the pressure applied by the compression spring means. As a result, it is sufficient for the radially inner end of the hammer and the slide ring to cooperate on a single sliding surface so that overlapping or interengaging parts for a positive coupling are not required and a very compact structure may be adopted. Besides, the drive is substantially effected by pressure forces so that high loads can be taken up in spite of the relatively small dimensions and the desired performance is ensured.

The compression spring means might consist of any spring elements by which the swaging hammers are urged against the slide ring with an adequate force. But it will be particularly desirable to provide compression springs consisting of cylinder-piston units, which are connected to a pressure accumulator, because this will result in a simple structure comprising hydraulic springs which exert the desired restoring forces and have an adequate compliance.

To permit an effective adjustment of the dead-center positions, the swaging hammer consists of two parts, which are adjustably connected by a screw-threaded joint and consist of a part, which is non-rotatably guided relative to the machine frame and a part, which is rotatably guided relative to the machine frame, and a rotary drive is associated with the rotatably guided part. Because the or each swaging hammer consists of a rotatable part and another part, which is non-rotatably guided but can be screwed relative to the rotatable part, the dead-center positions can be adjusted by simple and functionally reliable means. When the rotatable part is rotated by a suitable rotary drive, the fact that the other part is non-rotatably guided will cause the swaging hammer to be changed in length because the two parts are screwed one into or out of the other so that the dead-center positions will be changed as desired. It is sufficient to ensure that the rotation of one part will not affect the position of the die or the driving of the hammer. That requirement can be met in various ways, which may be selected in dependence on the nature of the drive means.

In an eccentric drive in which the radially inner end of each hammer and the slide ring are frictionally coupled, the non-rotatably guided part of the hammer suitably consists of its radially outer part, which is adjacent to the die, the rotatable part of the hammer consists of its radially inner part, which is adjacent to the eccentric, and the compression spring means engage flange extensions of the radially outer part. Owing to the frictional coupling between the swaging hammer and the slide ring it will then be possible to impart to the radially inner end of the hammer not only a transverse displacement but also a rotation relative to the slide ring so that the dead-center positions can be adjusted even during the operation of the swaging machine without a need for additional coupling elements which can be rotated relative to each other. Besides, the provision of the non-rotatable radially outer part ensures the proper action of the swaging die and a satisfactory engagement of the compression spring means with the flanges. Any pressure changes which may be required can be compensated by a proper adaptation of the spring excursion. Because the joint between the radially outer and inner parts is mainly required to permit a change in length by the screw-threaded joint, it will not matter whether the radially inner part of the screw-threaded joint is screwed into the radially outer part or the radially outer part is screwed into the inner part. The design of that screw-threaded joint may be selected in consideration of the structure of the swaging machine concerned.

To ensure that the drive for rotating the radially inner part need not follow the reciprocating motion of said part, the rotary drive may comprise a gear train comprising a ring gear, which is non-rotatably and axially slidably mounted on the radially inner part and is rotatably and non-displaceably mounted in the machine frame so that a gear which is mounted on a fixed axis in the machine frame may be used to rotate the ring gear as desired without obstructing the reciprocating motion of the radially inner part.

Owing to the frictional driving connection and the fact that means for adjusting the dead-center positions are associated with each hammer, the eccentric shafts may be mounted in simple rotary bearings and there will be no need to change the central axis of such bearings. For this reason there is no need for a provision of adjusting housings and the eccentric shafts may be driven by simple gear trains, such as spur gears, and all requirements for a simple design of the machine frame have been met. In that case the machine frame may substantially consist of two end wall plates, which are clamped against each other with spacers interposed, which preferably constitute a framelike array, so that the swaging box is most desirable and in spite of involving only a low expenditure has a high strength.

DETAILED DESCRIPTION OF THE PREFERRED EMBODIMENTS

Figure 1:
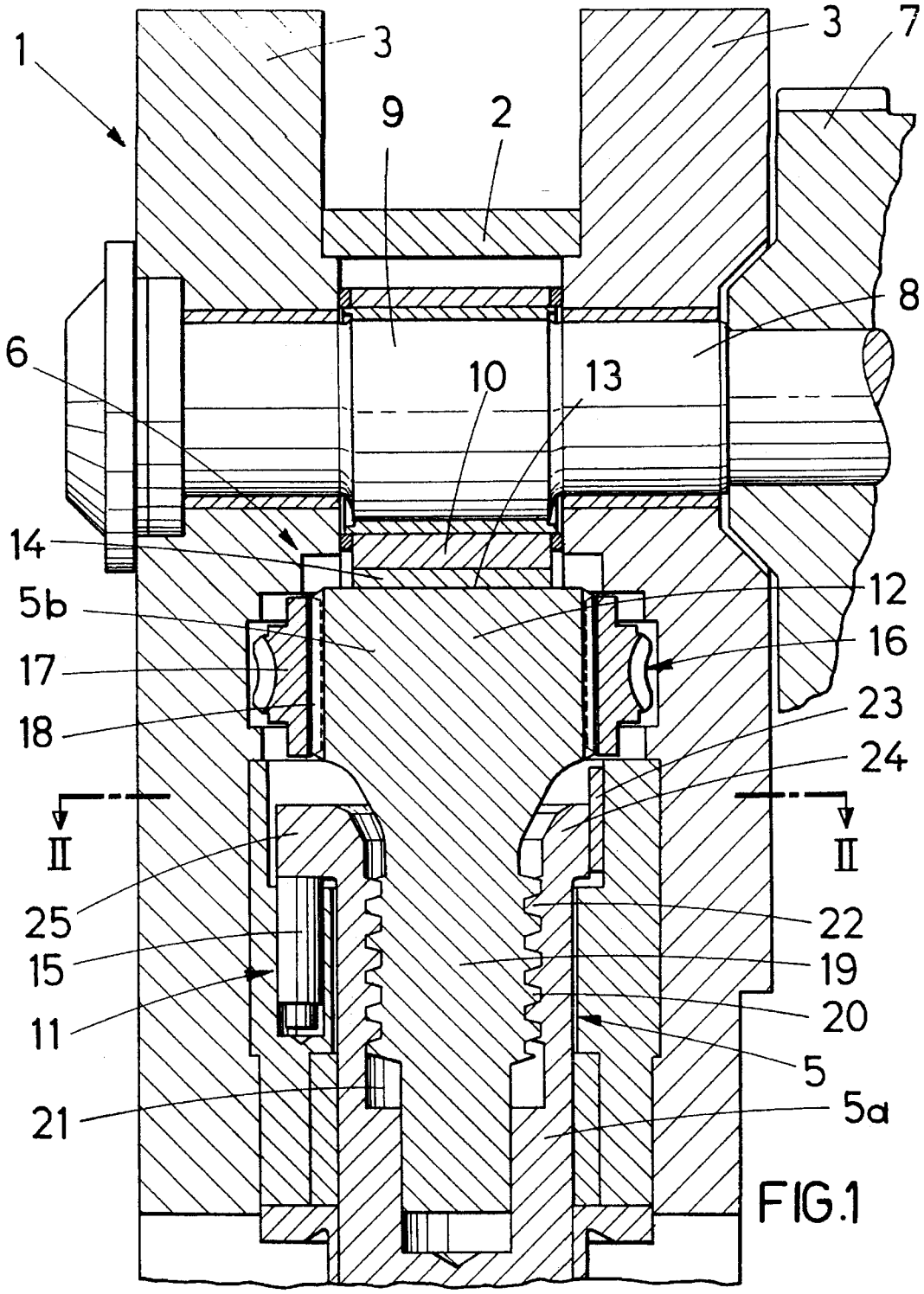
FIGS. 1 and 2 are, respectively, an axial sectional view taken on line I—I in FIG. 2 and a transverse sectional view taken on line II—II in FIG. 1 and show a part of a swaging machine in accordance with the invention.

The invention will now be explained more in detail with reference to the drawing.

A machine frame 1 substantially consists of two parallel end wall plates and interposed spacers 2, which constitute a framelike array and against which the end wall plates 3 are clamped. Connecting rod-like swaging hammers 5, which at one end 4 carry swaging dies, not shown, are radially guided in the machine frame 1 with respect to the axis of an eccentric drive 6 for reciprocating said hammers. The eccentric drive 6 comprises an eccentric shaft 8, which is rotatably mounted in the machine frame 1 and is adapted to be driven by a drive gear 7 and is non-rotatably connected to an eccentric 9, which is surrounded by a rotatably mounted slide ring 10. The slide ring 10 is merely non-frictionally coupled to the swaging hammer 5, which is biased by compression springs 11, by which a sliding surface 13 at the radially inner end 12 of the swaging hammer 5, i.e., at that end which is adjacent to the eccentric 9, is urged against the slide ring 10. To permit a control of the frictional and sliding conditions, a bearing plate 14 is provided, which is adapted to be secured to the slide ring 10 or the radially inner end of the hammer and which consists of a suitable material or provided with suitable lubricating passages. For this reason a rotation of the eccentric 9 will urge by means of the slide ring 10 the swaging hammer 5 radially outwardly to perform a working stroke and the return stroke will be imparted to the hammer 5 by the pressure applied by the compression springs 11. Said compression springs consist of hydraulic springs consisting of hydraulic cylinder-piston units 15, which are connected to a pressure accumulator that is not shown.

To permit a simple adjustment of the dead-center positions, the swaging hammer 5 comprises a radially outer part **5*a*, which is adjacent to the die, and a radially inner part 5*b*, which is adjacent to the eccentric, and said parts 5*a* and 5*b* are interconnected by a screw-threaded joint. The radially outer part 5*a* is non-rotatably guided in the machine frame 1. The radially inner part 5*b* can be rotated by a rotary drive 16. That rotary drive 16 comprises a ring gear 17, e.g., a worm wheel, which is rotatably and non-displaceably mounted in the machine frame 1 and which by means of axial teeth 18 is non-rotatably and axially slidably mounted on the radially inner part 5*b*. For this reason a rotation of the ring gear 17 will impart a rotation to the radially inner part 5*b* of the swaging hammer 5 without obstructing its reciprocating motion, and because the radially inner part 5*b* is connected to the radially outer part 5*a* of the hammer 5 by a screw-threaded joint and is non-rotatably guided a rotation of the radially outer part 5*b* will cause a change of the length of the swaging hammer 5 and, as a result, an adjustment of the dead-center positions of the swaging die, which is mounted at the radially outer end 4 of the swaging hammer 5**.

Figure 2:
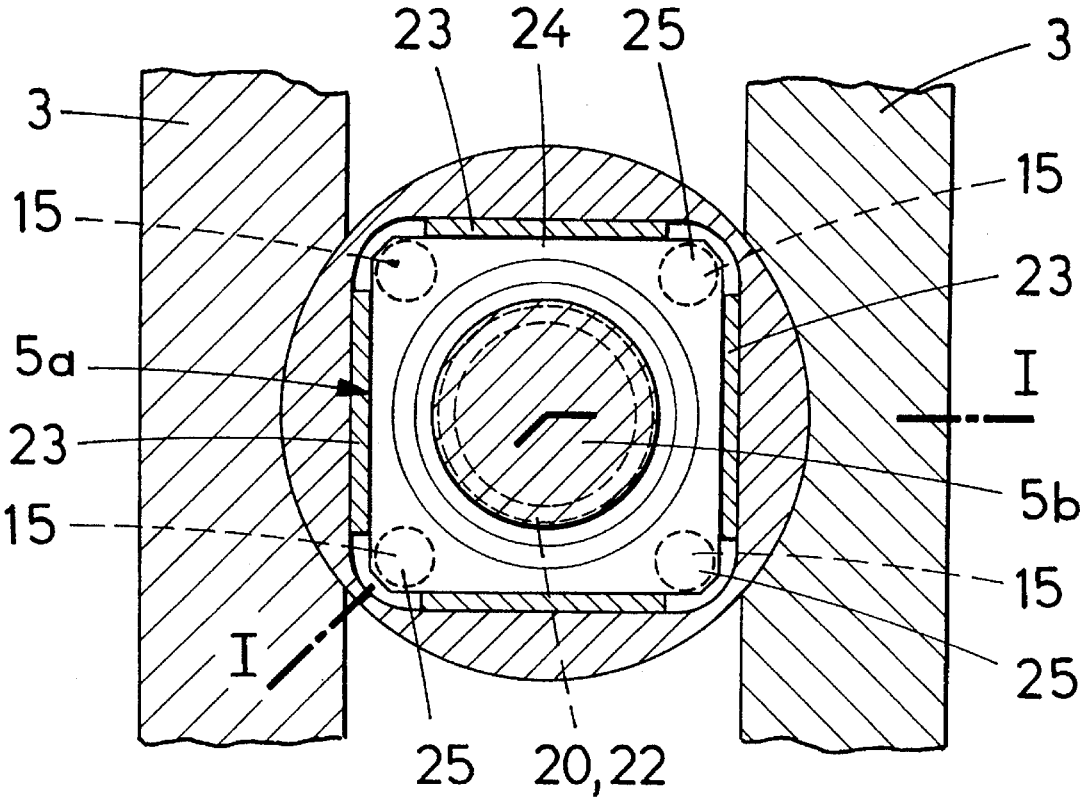

In the illustrative embodiment shown in FIGS. 1 and 2 the radially inner part **5*b* comprises a radially outwardly extending coupling pin 19, which is provided with external screw threads 20, and the radially outer part 5*a* has an internal bore 21, which is formed with internal screw threads 22. The radially outer part 5*a* is exactly non-rotatably guided in the machine frame by rectilinear guides 23, which cooperate with a square end flange 24 of the radially outer part 5*a*. The corner portions 25 of the end flange 24 constitute flange extensions, with which the compression springs 11** engage.

Figure 4:
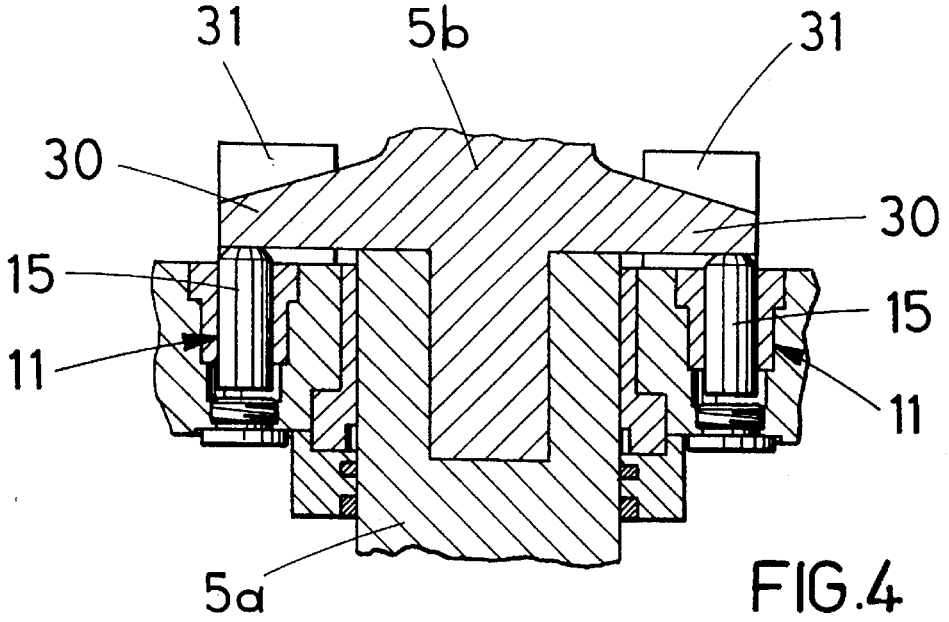
FIGS. 3 and 4 are, respectively, an axial sectional view taken on the axis of the eccentric shaft and the swaging hammer and an axial sectional view taken on line IV—IV in FIG. 3 and show a somewhat modified embodiment of a swaging machine in accordance with the Invention.
Figure 3:
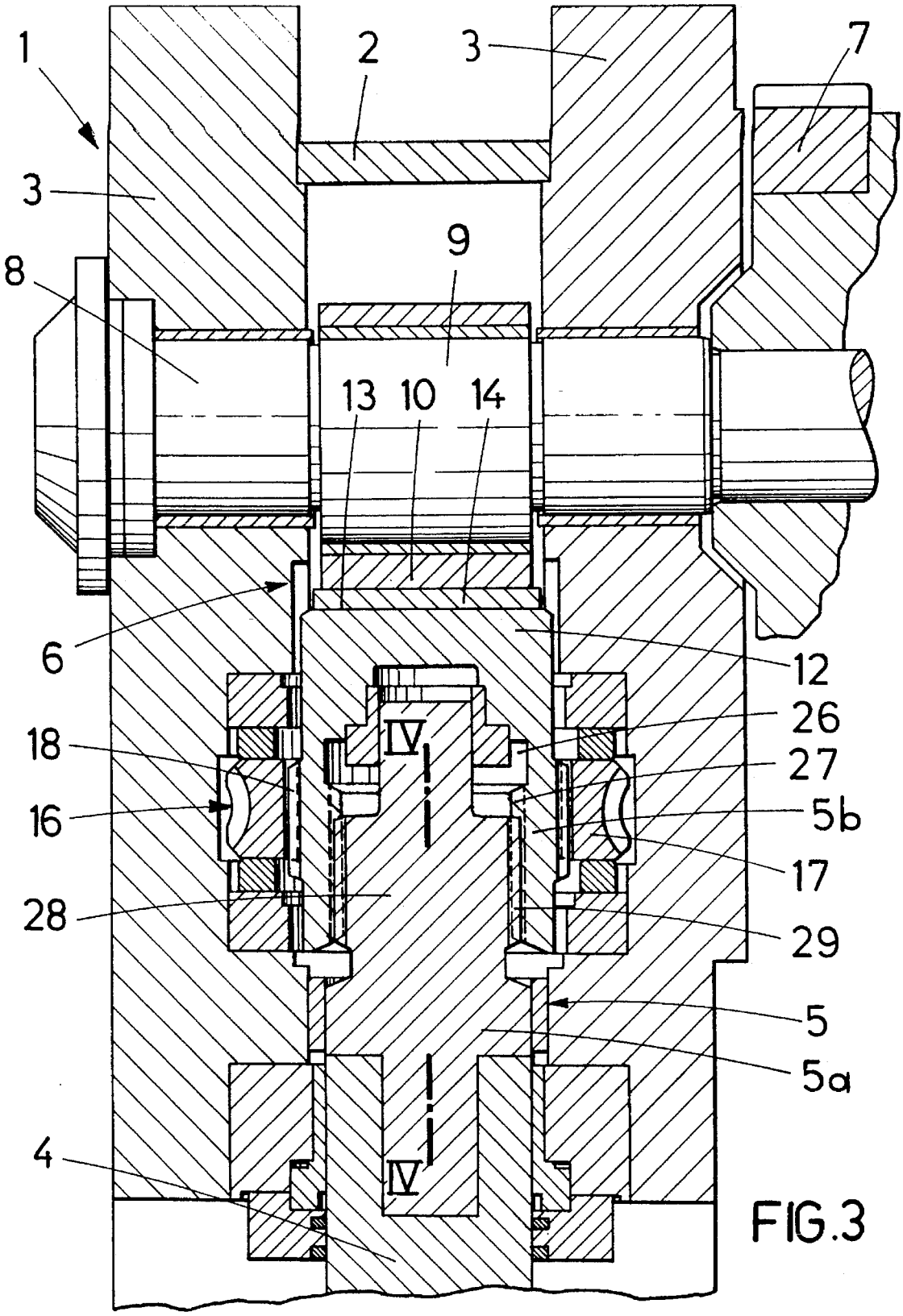

In the illustrative embodiment shown in FIGS. 3 and 4 the radially inner part **5*b* of the swaging hammer 5 is formed with an internal bore 26, which is formed with internal screw threads 27, into which the radially outer part 5*a* can be screwed. That radially outer part 5*a* comprises a radially inwardly protruding pin 28, which is formed with external screw threads 29. Two diametrically opposite, protruding flange extensions 30 are provided in the transitional region between the pin 28 and the cylindrical radially outer part 5*a* and are guided by guide slots 31 to hold the radially outer part 5*a* against rotation relative to the machine frame 1. A compression spring 11 engages each flange extension 30**.

Regardless of the nature of the screw-threaded joint connecting the radially outer part **5*a* and the radially inner part 5*b*, a rotation imparted to the radially inner part 5*b* by the rotary drive 16 will effect an adjustment of the dead-center positions of the swaging dies. Owing to the nonpositive driving connection between the eccentric 9 and the radially inner end 12** of the swaging hammer the swaging machine is particularly simple, compact and powerful.

I claim:

1. In a swaging machine comprising a machine frame, an eccentric shaft mounted in said machine frame for rotation on an axis, an eccentric non-rotatably mounted on said eccentric shaft, a connecting-rod like swaging hammer, which is radially guided in said machine frame with respect to said axis and is operatively connected to said eccentric by a slide ring that surrounds and is rotatably mounted on said eccentric, wherein a sliding surface formed on said hammer at its radially inner end is in sliding contact with said slide ring, the improvement residing in that said sliding surface is merely in frictional contact with said slide ring and compression spring means are supported in said machine frame and arranged to apply pressure to said hammer to urge said sliding surface against said slide ring.

2. A swaging machine as set forth in claim 1, wherein said compression spring means consist of at least one cylinder-piston unit, which is connected to a pressure accumulator.

3. The improvement set forth in claim 1 as applied to a swaging machine comprising a plurality of said connecting rod-like swaging hammers, each of which is associated with one of said eccentric shafts, one of said eccentrics and one of said slide rings, wherein said sliding surface of each of said hammers is merely in frictional contact with the associated slide ring, and compression spring means are associated with each of said hammers and supported in said machine frame and arranged to apply pressure to the associated hammer to urge said sliding surface thereof against the associated slide ring.

4. The improvement set forth in claim 3, wherein each of said compression spring means consist of at least one cylinder-piston units and said cylinder-piston units are connected to a comcon pressure accumulator.

5. The improvement set forth in claim 1, wherein said machine frame comprises two end wall plates and spacers, which are clamped between said end wall plates.

6. The improvement set forth in claim 5, wherein said spacers constitute a framelike array.

7. The improvement set forth in claim 1 as applied to a swaging machine in which said swaging hammer is longitudinally guided in said machine frame, wherein said swaging hammer comprises a first part, which is non-rotatably guided relative to said machine frame, a second part, which is rotatably guided relative to said machine frame, and a rotary drive for rotating said second part, the rotary drive comprising (1) a gear train comprising a ring gear, which is non-rotatably and axially slidably mounted on said rotatably guided part and is rotatably and non-displaceably mounted in said machine frame.

8. The improvement set forth in claim 7, wherein said non-rotatably guided part of said hammer is a radially outer part with respect to said eccentric, said rotatably guided part of said hammer is a radially inner part with respect to said eccentric, and said compression spring means engage said radially inner part.

9. In a swaging machine comprising a machine frame, an eccentric shaft mounted in said machine frame for rotation on an axis, an eccentric non-rotatably mounted on said eccentric shaft, a connecting-rod like swaging hammer, which is longitudinally guided in said machine frame and adapted to be driven by said eccentric, wherein said swaging hammer comprises a first part, which is non-rotatably guided relative to said machine frame, a second part, which is rotatably guided relative to said machine frame, and a rotary drive for rotating said second part, the rotary drive comprising (1) a gear train comprising a ring gear, which is non-rotatably and axially slidably mounted on said rotatably guided part and is rotatably and non-displaceably mounted in said machine frame.

10. The improvement set forth in claim 9 as applied to a swaging machine comprising a plurality of said connecting rod-like swaging hammers, each of which is associated with one of said eccentric shafts and one of said eccentrics, wherein each of said swaging hammers comprises a first part, which is non-rotatably guided relative to said machine frame, a second part, which is rotatably guided relative to said machine frame, and a rotary drive for rotating said second part of each of said hammers.

* * * * *